US007347151B1

(12) United States Patent
Johnston et al.

(10) Patent No.: US 7,347,151 B1
(45) Date of Patent: Mar. 25, 2008

(54) CONTROL ASSEMBLY FOR TUFTING MACHINE

(75) Inventors: Kendall Johnston, Dalton, GA (US); William M. Christman, Jr., Hixson, TN (US)

(73) Assignee: Card-Monroe, Corp., Chattanooga, TN (US)

( * ) Notice: Subject to any disclaimer, the term of this patent is extended or adjusted under 35 U.S.C. 154(b) by 10 days.

(21) Appl. No.: 11/215,056

(22) Filed: Aug. 30, 2005

Related U.S. Application Data

(60) Provisional application No. 60/605,632, filed on Aug. 30, 2004.

(51) Int. Cl.
*D05C 15/00* (2006.01)

(52) U.S. Cl. ..... 112/80.01; 112/80.5; 112/80.51; 112/80.55; 700/136

(58) Field of Classification Search ..... 112/80.01, 112/80.3, 80.32, 80.42, 80.55, 2.1, 2.2, 80.5, 112/80.51, 80.52, 80.56, 80.58, 80.59, 80.23, 112/410, 475.18, 475.19, 475.23, 80.57; 700/130, 131, 136, 143
See application file for complete search history.

(56) References Cited

U.S. PATENT DOCUMENTS

| | | | | | |
|---|---|---|---|---|---|
| 2,213,552 | A | | 9/1940 | Scharr | |
| 2,879,728 | A | | 3/1959 | McCutchen | |
| 3,103,903 | A | | 9/1963 | Broadrick et al. | |
| 3,272,163 | A | * | 9/1966 | Erwin, Jr. et al. | 112/80.24 |
| 3,375,797 | A | | 4/1968 | Gaines | |
| 3,489,326 | A | | 1/1970 | Singleton | |
| 3,709,173 | A | | 1/1973 | Greene | |
| 3,835,797 | A | | 9/1974 | Franks et al. | |
| 3,847,098 | A | | 11/1974 | Hammel, Jr. | |
| 3,922,979 | A | * | 12/1975 | Ingham et al. | 112/80.23 |
| 3,926,132 | A | | 12/1975 | Lear et al. | |
| 3,976,298 | A | | 8/1976 | Hinchman | |
| 4,103,629 | A | * | 8/1978 | Card | 112/80.51 |
| 4,111,646 | A | | 9/1978 | Buckwalter et al. | |
| 4,134,347 | A | * | 1/1979 | Jolley et al. | 112/80.51 |
| 4,134,348 | A | | 1/1979 | Scott | |
| 4,155,319 | A | * | 5/1979 | Short | 112/80.51 |
| 4,185,569 | A | * | 1/1980 | Inman | 112/80.51 |
| 4,301,752 | A | * | 11/1981 | Ingram et al. | 112/80.56 |
| 4,320,711 | A | * | 3/1982 | Slattery et al. | 112/80.53 |
| 4,369,720 | A | * | 1/1983 | Beasley | 112/80.51 |
| 4,382,704 | A | | 5/1983 | Hendrschk | |
| 4,466,366 | A | * | 8/1984 | Hirotsu | 112/80.56 |

(Continued)

FOREIGN PATENT DOCUMENTS

| | | |
|---|---|---|
| GB | 1 507 166 | 5/1975 |

(Continued)

*Primary Examiner*—Gary L. Welch
*Assistant Examiner*—Nathan E Durham
(74) *Attorney, Agent, or Firm*—Womble, Carlyle, Sandridge & Rice, PLLC

(57) ABSTRACT

A tufting machine and a method of controlling a tufting machine for forming cut and loop pile tufts of yarns in a backing material that includes a hook assembly having a series of hooks/loopers and a series of clips independently moveable between extended and retracted positions. The movement of the clips between their extended and retracted positions is selectively activated to cause transitions from cut pile tufts to loop pile tufts and loop pile tufts to cut pile tufts according to programmed pattern information.

9 Claims, 10 Drawing Sheets

U.S. PATENT DOCUMENTS

| | | | | | |
|---|---|---|---|---|---|
| 4,532,667 | A | | 8/1985 | Komesker et al. | |
| 4,608,935 | A | | 9/1986 | Bardsley | |
| 4,660,460 | A | | 4/1987 | Fulmer | |
| 4,822,241 | A | | 4/1989 | Jarvis et al. | |
| 4,856,441 | A | | 8/1989 | Kurata | |
| 4,860,674 | A | * | 8/1989 | Slattery | 112/80.42 |
| 4,864,946 | A | | 9/1989 | Watkins | |
| 4,867,080 | A | * | 9/1989 | Taylor et al. | 112/80.32 |
| 4,981,091 | A | * | 1/1991 | Taylor et al. | 112/80.32 |
| 5,094,178 | A | | 3/1992 | Watkins | |
| 5,158,027 | A | * | 10/1992 | Ingram | 112/80.08 |
| 5,182,997 | A | | 2/1993 | Bardsley | |
| 5,544,605 | A | | 8/1996 | Frost | |
| 5,575,228 | A | | 11/1996 | Padgett, III et al. | |
| 5,622,126 | A | | 4/1997 | Card et al. | |
| 5,738,027 | A | * | 4/1998 | White | 112/80.55 |
| 5,743,201 | A | | 4/1998 | Card et al. | |
| 5,899,152 | A | | 5/1999 | Bardsley et al. | |
| 5,979,344 | A | * | 11/1999 | Christman, Jr. | 112/80.23 |
| 5,983,815 | A | | 11/1999 | Card | |
| 6,009,818 | A | | 1/2000 | Card et al. | |
| 6,105,522 | A | | 8/2000 | Kato | |
| 6,155,187 | A | * | 12/2000 | Bennett et al. | 112/80.51 |
| 6,213,036 | B1 | | 4/2001 | Slattery | |
| 6,244,203 | B1 | | 6/2001 | Morgante et al. | |
| 6,260,493 | B1 | | 7/2001 | Dean | |
| 6,263,811 | B1 | | 7/2001 | Crossley | |
| 6,283,053 | B1 | | 9/2001 | Morgante et al. | |
| 6,293,210 | B1 | * | 9/2001 | Freeman et al. | 112/80.01 |
| 6,293,211 | B1 | * | 9/2001 | Samilo | 112/80.16 |
| 6,439,141 | B2 | | 8/2002 | Morgante et al. | |
| 6,446,566 | B1 | | 9/2002 | Bennett et al. | |
| 6,502,521 | B2 | | 1/2003 | Morgante et al. | |
| 6,508,185 | B1 | | 1/2003 | Morgante et al. | |
| 6,516,734 | B1 | | 2/2003 | Morgante et al. | |
| 6,550,407 | B1 | | 4/2003 | Frost et al. | |
| 6,758,154 | B2 | | 7/2004 | Johnston | |
| 6,807,917 | B1 | | 10/2004 | Christman et al. | |
| 6,834,601 | B2 | | 12/2004 | Card | |
| 6,834,602 | B1 | * | 12/2004 | Hall | 112/80.55 |
| 6,971,326 | B1 | * | 12/2005 | Clarke et al. | 112/475.23 |
| 2002/0043202 | A1 | * | 4/2002 | Freeman et al. | 112/80.23 |
| 2004/0187268 | A1 | | 9/2004 | Johnston | |

FOREIGN PATENT DOCUMENTS

| | | |
|---|---|---|
| GB | 2 002 040 | 7/1978 |
| GB | 2354263 | 4/2000 |
| GB | 2367305 | 7/2003 |
| WO | WO 01/20069 | 3/2001 |
| WO | WO 2005/054561 | 6/2005 |

* cited by examiner

CONTROL ASSEMBLY FOR TUFTING MACHINE

CROSS REFERENCE TO RELATED APPLICATION

The present application claims priority to U.S. Provisional Patent Application Ser. No. 60/605,32, filed Aug. 30, 2004.

FIELD OF THE INVENTION

The present invention is related to a tufting machine, and more particularly to a tufting machine for forming level cut and loop pile tufts in tufted articles.

BACKGROUND OF THE INVENTION

Tufting machines are widely used for manufacturing tufted pile fabrics, such as carpeting. Tufting machines have a plurality of yarn carrying needles. During a tufting operation, the portions of the needles carrying the yarns pass though a heavy fabric backing to form loops of yarn below the fabric. Loopers or hooks that are located below the fabric are oscillated to capture the loops of yarn so that when the needles are withdrawn from the fabric, the loop is held below the fabric to form loop pile tufts. Additionally, the tufting machines can include knives for cutting loops of yarns to form cut pile tufts, and gates that can be extended to control whether the loops of yarn are cut by the knives.

Conventional level cut loop type tufting machines also can have hundreds of clips that are moveable into engagement with the hooks/loopers to control formation of loop and cut pile tufts in the backing, each of the clips generally being located below and/or behind one of the hooks. After the yarn is released from the hook or cut by a knife, the fabric can be advanced so that the yarn carrying needles can create the next set of loops in the backing. As a result, the tufting machine can selectively generate both loop and cut pile tufts in the backing material.

Such tufting machines also generally have gates that are coupled to the clips. Pneumatic cylinders are coupled to the gates and are selectively actuated to move both the gates and the clips. The reaction time required for the cylinders to actuate and move the gates typically can limit the speed of operation of the tufting machine. Further, due to the constant actuation/de-actuation of the pneumatic cylinders during the tufting process, the gates and the clips are particularly vulnerable to wear, fatigue, and malfunctions. As a result, when the apparatus malfunctions, the tufting process typically must be stopped for repair. For example, the gates and the clip may become uncoupled resulting in malfunctioning of the gate or clip. If the gate malfunctions, such as by not properly extending, the loop will not be released from the hook, resulting in the production of a flawed tufted product.

SUMMARY OF THE INVENTION

Briefly described, in accordance with one example embodiment of the present invention, a tufting machine is provided having a frame with a base, a head portion, and typically a yarn feed attachment mounted on the head portion of the tufting machine. The yarn feed attachment generally includes yarn feed controls and a series of rolls that feed yarns through the yarn feed controls to the needles of the tufting machine. A hook assembly is mounted below the bed of the tufting machine and includes a series of spaced hooks or loopers and a series of clips for engaging the hooks/loopers to control formation of cut and loop tufts. The hook assembly further can connect the output shafts of a series of gate actuators to a series of gates for moving associated clips into and out of engagement with one or more hooks/loopers of the tufting machine. The actuators can be pneumatic cylinders or servo-actuators, and their output shafts can include an extension or forward portion that extends toward an associated gate of the tufting machine and ends in a connector slot configured to engage the gate.

In another embodiment, the hook assembly for the tufting machine can comprise a hook block that rigidly supports at least first and second hooks/loopers and slidably receives and supports at least first and second clips adjacent to their respective first and second hooks/loopers. An actuator block supports at least first and second gate actuators disposed respectively in first and second vertically offset rows. A first connector or gate is connected to an output shaft of the first actuator and includes an extension portion that extends from the output shaft of the first actuator toward the first clip and includes a first connector slot. A second connector or gate can be provided, generally being connected to an output shaft of the second actuator, and including an extension portion that extends from the output shaft of the second actuator toward a second clip and includes a second connector slot extending from the second extension portion. The first and second actuators generally are configured to reciprocally drive the first and second connectors/gates, respectively, in an axial direction, to move their selective clips according to the programmed instructions, wherein the first and second actuator connector portions are respectively connected to the output shafts of the first and second actuators with sufficient rigidity to prevent rotation of the first and second connectors about a generally horizontal axis.

In still another embodiment, the hook assembly can comprise a hook/looper support rigidly supporting at least first and second hooks and slidably receiving and supporting at least first and second clips adjacent to the respective first and second hooks. An actuator block supports at least first and second actuators disposed respectively in first and second vertically offset rows. A first connector/gate comprising a first actuator connector portion generally is connected to an output shaft of the first actuator, with a first extension portion extending vertically upwardly from the first actuator connector portion and a first connector slot extending from the first extension portion and including lateral walls extending adjacent to two lateral sides of the first clip. A second connector/gate comprising a second actuator connector portion is connected to an output shaft of the second actuator, with a second extension portion extending vertically downwardly from the second actuator connector portion and having a second connector slot therein. The first and second actuators are configured to reciprocally drive the first and second connectors/gates in an axial direction for controlling movement of the selected clips.

The gate actuators generally are pneumatic actuators that are connected via conduits or air supply lines to an air source, which can include one or more air tanks with a distribution board, manifold, or plenum mounted to at least one, and/or both of the air tanks. The manifold will include a series of air valves with integrated solenoid actuators, output relays, or other, similar controls for opening and closing the valves to turn on/off the supply of air or fluid to the gate actuators as needed for actuating and moving specific, individual clips between their extended and retracted positions.

The tufting machine generally will be controlled by a computer control system, such as a Command Performance System manufactured by Card-Monroe Corp., that typically will include a central or master controller or computer running desired programmed or stored pattern information. At the start of a pattern cycle, a series of cuts and loops for a level cut loop tufted article generally are transformed into at least two sets of data (i.e., set 1=cut to loop transition data, set 2=loop to cut transition data). Thereafter, during operation, the main shaft of the tufting machine will be constantly monitored to calculate the instant speed and/or position of the main shaft, and thus the needles, during a tufting operation.

The system further typically is adapted to look one or more steps or stitches ahead of a current sewing step to determine firing points for both cut to loop and loop to cut transitions. These firing points can be varied as needed to time completion of the firing cycle with the completion of machine operation cycle going from cut to loop and/or loop to cut. In addition, the system can calculate two or more firing points per revolution of the tufting machine main shaft or per each stroke or cycle of the needles of the tufting machine.

The operation of the control system for firing the actuators as needed to make the transitions from cut pile to loop pile tufts and from loop to cut pile tufts can be carried out by various mechanisms. For example, a network mode can be used in which a series of processors are provided for controlling groups of one or more valves/relays for the gate actuators to enable changing of inputs and outputs of the valves/relays in parallel with a single message sent, or alternatively nearly in parallel with multiple messages, from the main computer or controller of the tufting machine control system. In such a system, the controller can send out a broadcast message over the network to tell each of the processors to make the change from either cut to loop or loop to cut, and will further update each of the processor as to the next step or steps to be performed in the pattern.

Alternatively, a streaming and double buffering mode for operating the looper cut loop tufting operation. In such a mode of operation, the controller of the tufting machine control system will send out signals to groups of one or more of the solenoid activated air valves, typically starting with the air valves for the group(s) of actuators furthest out of phase from the operation of the tufting machine, i.e., based on position of the main shaft for the next transition or firing point. Thus, the firing signal for activating each actuator or set of actuators generally will be sent in time sufficient to compensate for any delay in the timing of the firing signal reaching or getting to each actuator or set of actuators. Accordingly, the controller will monitor and adjust the sending of the firing signals based upon the speed of the machine at the time the firing signal is being sent, so as to ensure that each firing signal sent will reach its actuator or set of actuators in sufficient time necessary to actuate the firing substantially simultaneously with the firing of the other actuators or sets of actuators as needed for forming the desired level cut loop pattern.

Alternatively, a network/serial communication path can be used to directly set the position to be either cut or loop, such as by using a network layout with sufficient speed to ensure timely receipt of firing signals by the actuators.

Various objects, features and advantages of the present invention will be apparent to those skilled in the art upon the review of the following detailed description when taken into conjunction with the accompanying drawings.

BRIEF DESCRIPTION OF THE DRAWINGS

FIGS. 7A and 7B are flow charts illustrating alternative embodiments for the actuation of the gates of the hook assembly of the tufting machine of the present invention, with FIG. 7A illustrating a networked serial output example embodiment, while FIG. 7B illustrates an example embodiment of control of one or more actuators in a parallel mode.

DETAILED DESCRIPTION OF THE INVENTION

Figure 1:
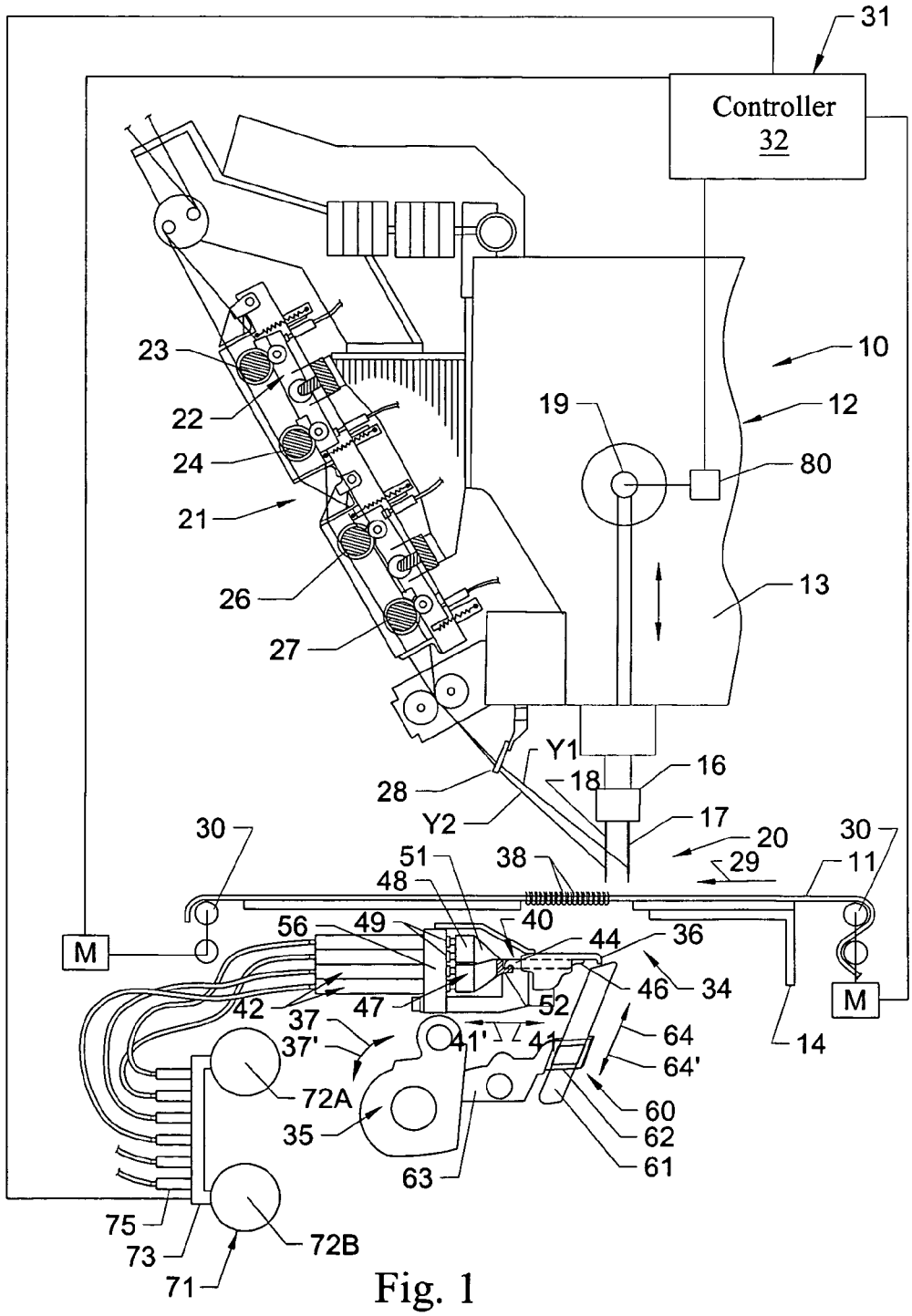
FIG. 1 is a partial and side elevational view of a tufting machine with a hook assembly according to the present invention; the tufting machine having a scroll attachment with two pairs of yarn feed rollers.

In accordance with one example embodiment of the present invention, as generally illustrated in FIGS. 1-5B, a tufting machine 10 for forming tufts of yarns in a fabric backing material 11 is provided. As shown in FIG. 1, the tufting machine 10 generally includes a frame 12, having a head or upper portion 13 attached to a base 14; at least one, or a pair of, needle bars 16 carrying spaced rows of needles 17/18 and driven off a main shaft 19 of the tufting machine and defining a tufting zone 20; and one or more yarn feed attachments 21. Each yarn feed attachment 21 generally includes a series of yarn feed controls 22 and a series of feed rolls 23, 24, 26 and 27 that feed yarns (shown at Y1 and Y2) through a guide 28, selected ones of the needles 17 and 18. The needle bar 16 further can be shiftable under control of a shift mechanism such as a "Smartstep" shifter as manufactured by Card-Monroe Corp., or other, similar shifter. The backing material 11 is fed through the tufting zone 20 along a feed direction/path in the direction of arrow 29 by backing feed rolls 30 for engagement by the needles 17/18 to insert the yarns Y1 and Y2 therein.

As indicated in FIG. 1, the operative elements of the tufting machine further generally can be monitored and controlled by a control system 31, which typically include a controller or computer/processor 32 that can be programmed with pattern information and which monitors and controls the tufting machine elements, such as operation of the yarn feed attachment(s) 21, backing feed rolls 30 and/or the hook assembly 34 discussed below. The system controller can control the tufting machine in accordance with the programmed pattern instructions or can receive and execute and/or store pattern information from a design center (not shown) separate from or which can be included as part of the control system 31.

Figure 2:
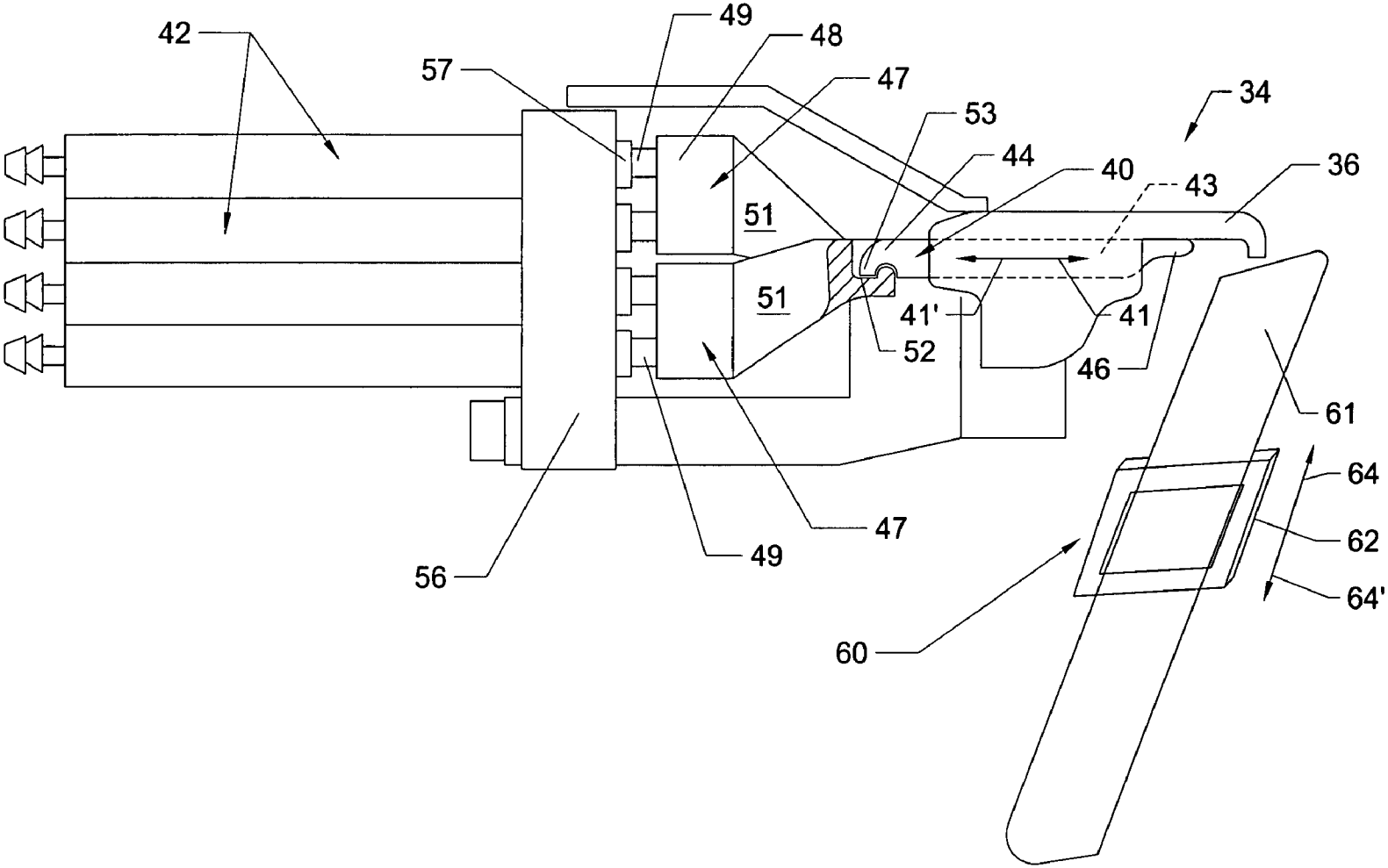
FIG. 2 is a partial sectional view of the hook assembly with gates and hooks.
Figure 3:
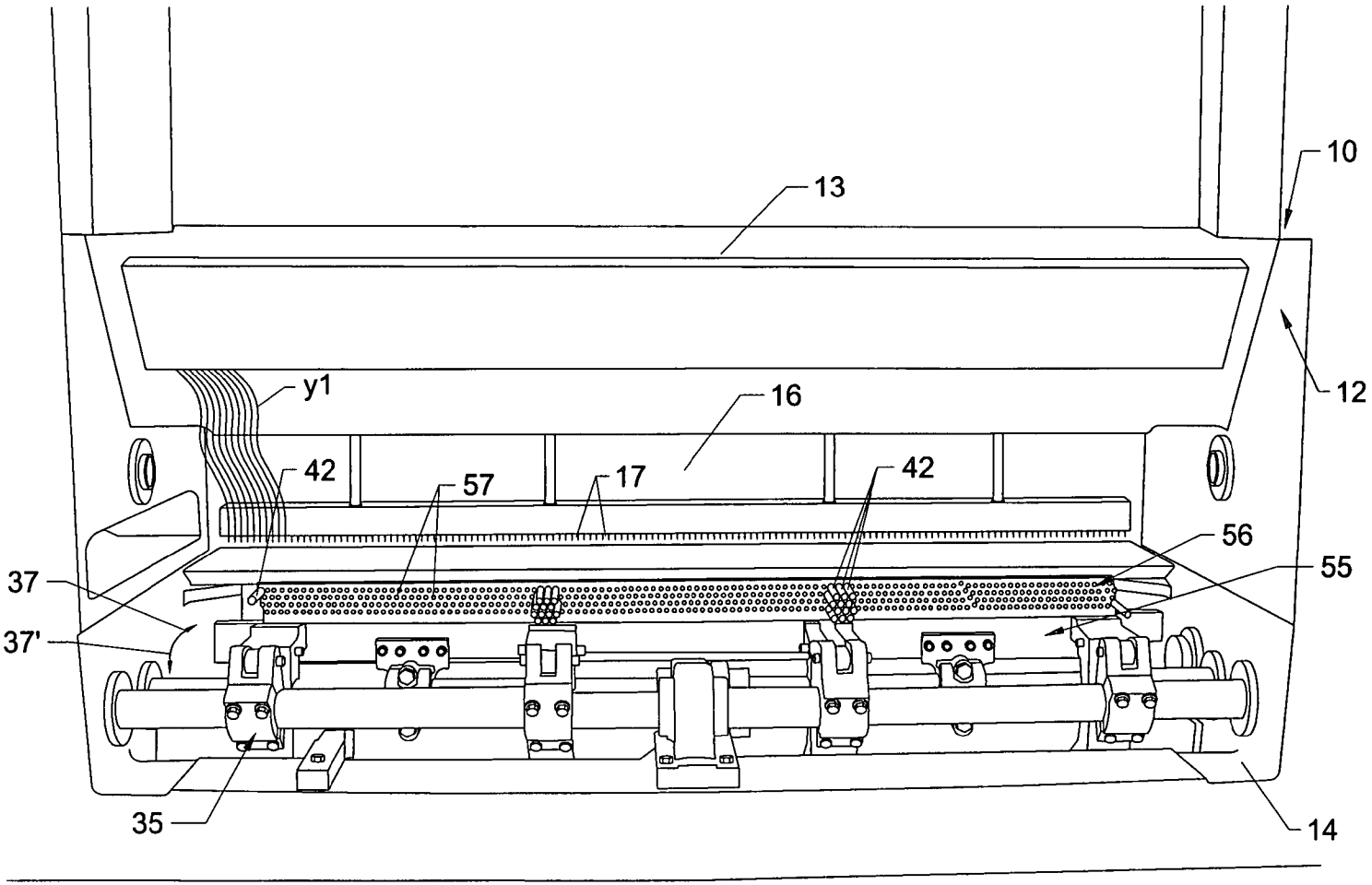
FIG. 3 is an end view of the tufting zone of the tufting machine of FIG. 1 incorporating the hook assembly of the present invention.
Figure 4A:
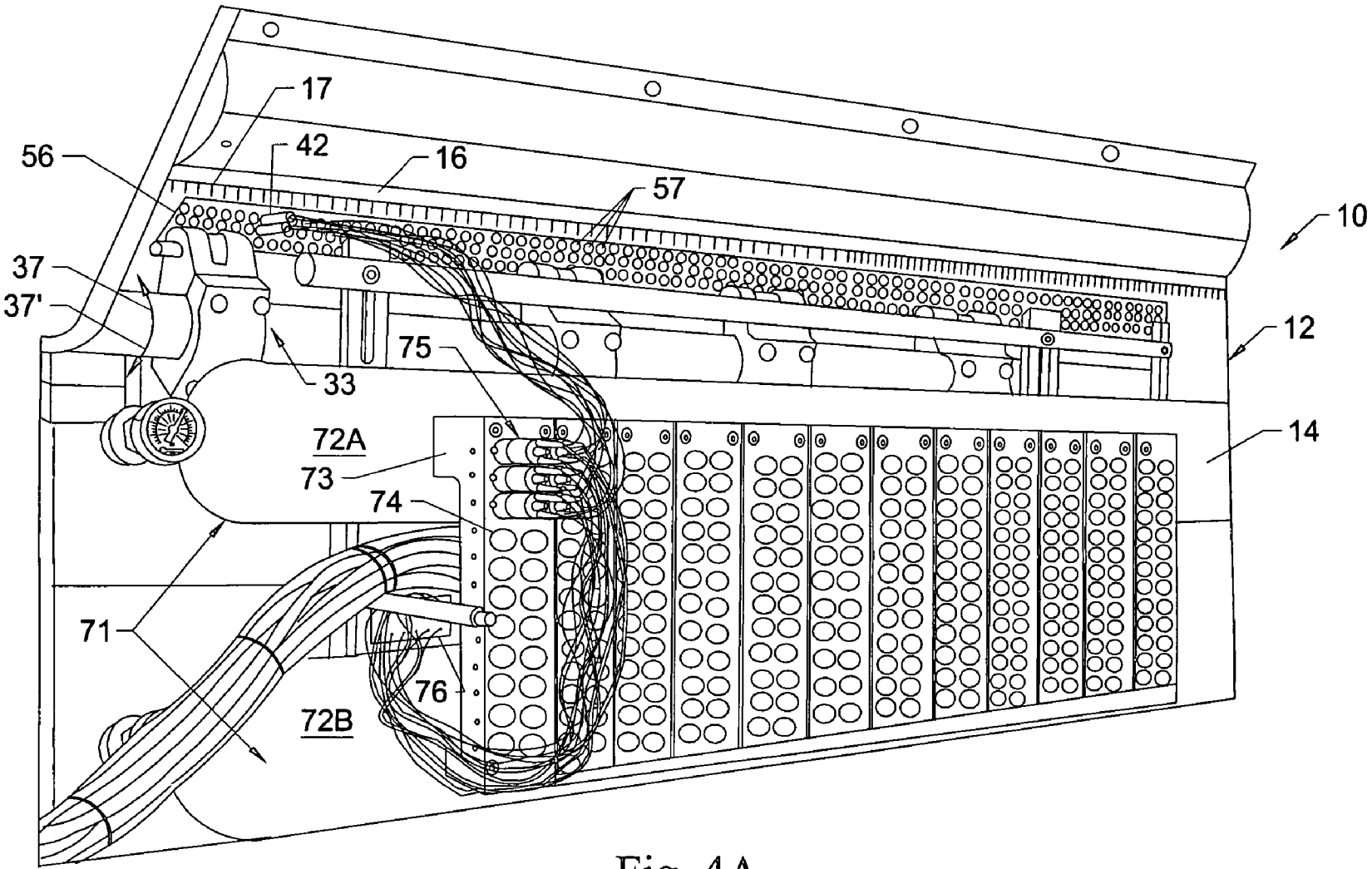
FIG. 4A is a perspective illustration of an example layout of the fluid supply and manifold of the tufting machine of FIG. 1.
Figure 4B:
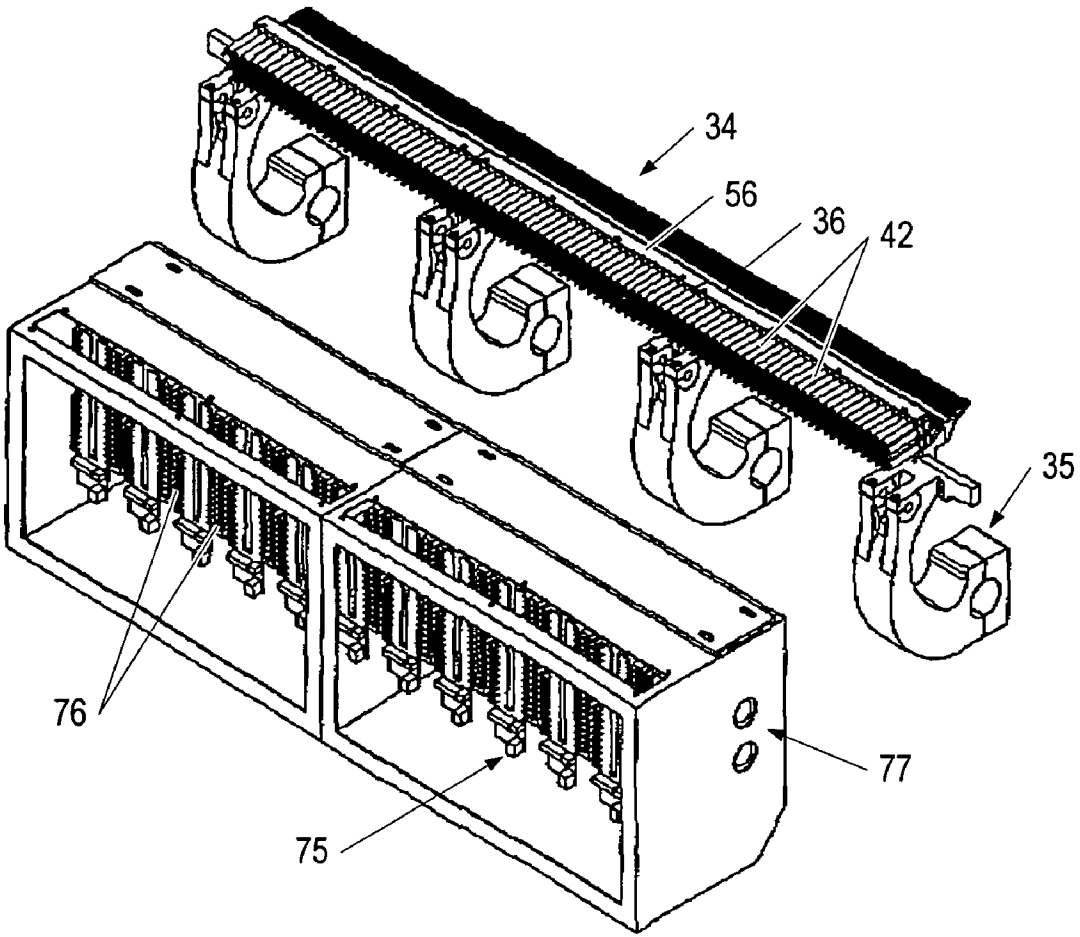
FIG. 4B is a perspective illustration of an additional example embodiment of the fluid supply system of the tufting machine of FIG. 1.
Figure 5A:
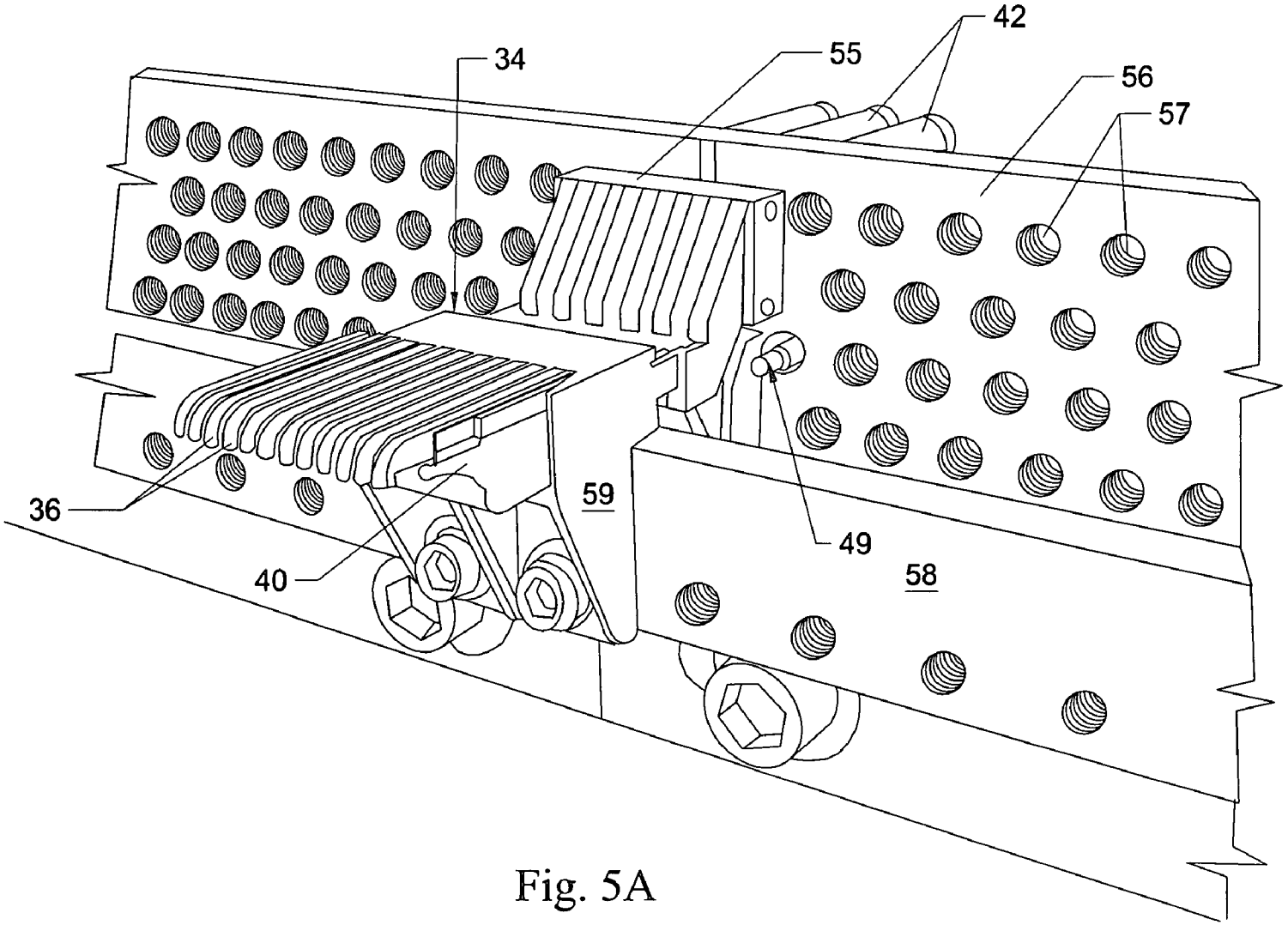
FIG. 5 is a perspective illustration of the hook assembly of the present invention.

As shown in FIGS. 1, 2, 3 and 4B, a hook assembly 34 is mounted below the bed and tufting zone of the tufting machine and generally includes a reciprocating drive mechanism 35 for moving a series of spaced hooks or loopers 36 in a reciprocating motion as indicated in FIG. 1 toward and away form the needles 17/18, as shown by arrows 37/37', as the needles penetrate the backing material to form loops 38 of yarns Y1/Y2 in the backing material 11. The hooks/loopers further can include cut/loop loopers as (as shown in FIG. 5A) having retaining clips for retaining loops of yarns Y1/Y2 thereon. Each of the hooks or loopers 36 of the hook assembly 34 further can be connected to a series of clips 40 as generally illustrated in FIG. 2, which gates are received within and are operable or movable through the hooks/loopers 36 in the direction of arrows 41 and 41', between open/extended and closed/retracted positions by actuators 42 to control the operation of one or more hooks/loopers of the tufting machine.

The clips 40 each include an elongated body 43, generally formed from a metal, composite materials or similar material, and have a first, proximal end 44, and a second, distal end 46 that extends through an associated hook or looper as shown in FIG. 2. Each clip is connected to its associated actuator(s) 42 by a connector or gate 47 that includes an actuator connector portion 48 configured to be connected to one or more output shafts 49 of one or more actuators 42, such as a hydraulic, pneumatic or other type cylinder, a servo-motor, or other similar drive mechanism or solenoid, and an extension portion 51 that extends upwardly or downwardly from the actuator connector portion 48 along a direction transverse to the axial direction of its clip and has a clip connector slot 52 formed thereon. The clip connector slot 52 of each connector/gate generally is configured to engage a hook or catch portion 53 formed in the first end 48 of its associated clip 40 as shown in FIGS. 1 and 2. The clip connector slot generally is substantially U-shaped and includes lateral side walls extending along and defining the lateral sides of the clip connector slot within which the catch portion 52 of the clip is received and held.

Figure 5B:
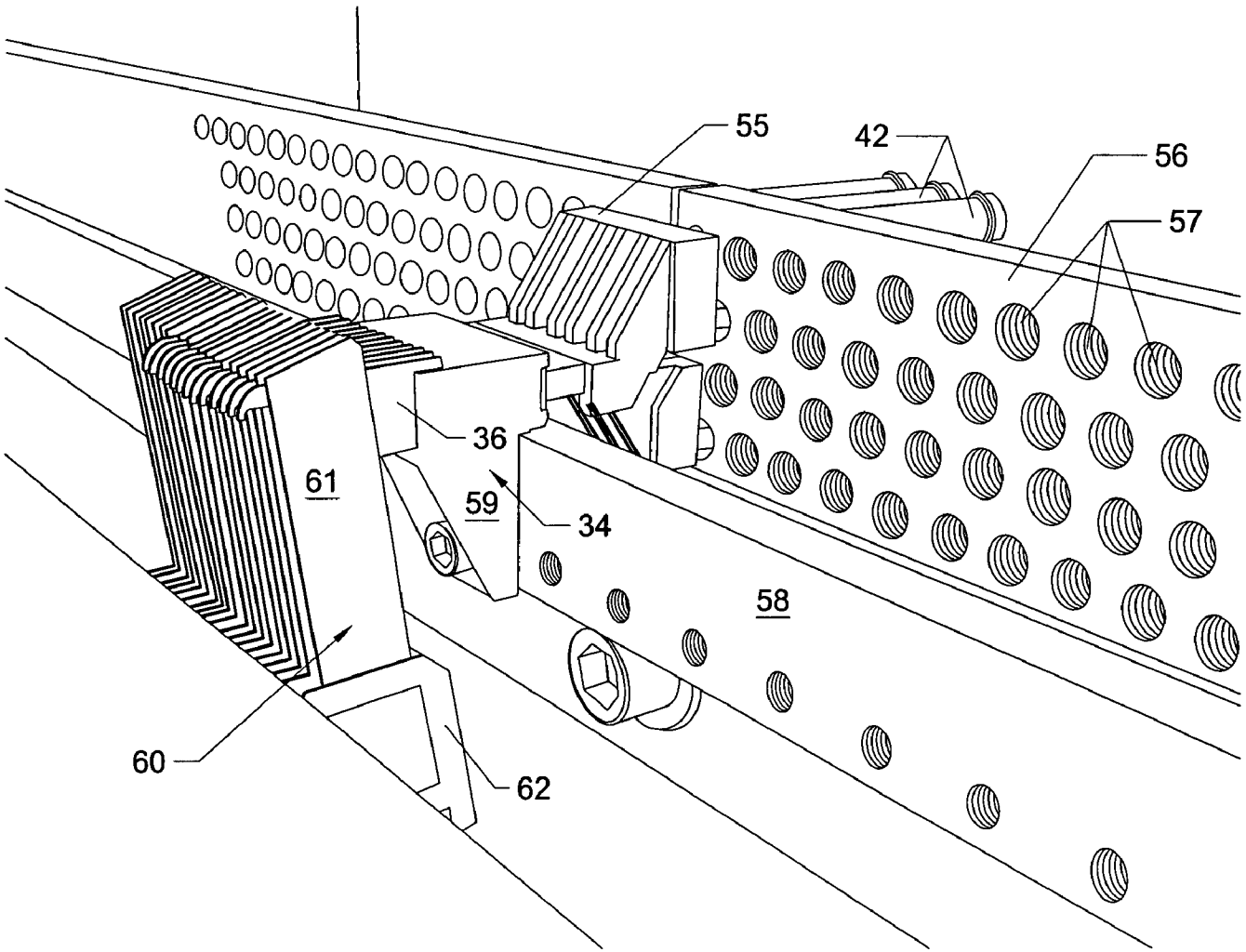

As generally shown in FIGS. 5A-5B, the hook-assembly 34 for the tufting machine also can comprise a plurality of hooks/loopers mounted on support block 55 that rigidly supports a series of hooks or loopers 36 and slidably supports a series of clips 40 adjacent and generally substantially in-line with their respective hooks. An actuator block 56 having a series of openings 57 for receiving a series of actuators 42 disposed respectively in first, second, etc. vertically offset rows is mounted adjacent the support block as generally shown in FIGS. 5A-5B.

Additionally, first and second actuators can be used to control each gate for moving its associated clip as needed between extended and retracted positions. A first connector/gate will have an actuator connector portion connected to the output shaft of the first actuator, a first extension portion that extends upwardly from the first actuator connector portion and a first clip connector slot extending from the first extension portion. A second connector/gate having a second actuator connector portion is connected to an output shaft of the second actuator, and includes a second extension portion that extends vertically downwardly from the second actuator connector portion and a second clip connector slot extending from the second extension portion. The first and second actuators can be configured to reciprocally drive the first and second connectors/gates in an axial direction, wherein the first and second actuator connector portions generally are connected to the output shafts of the first and second actuators, respectively, with sufficient rigidity to prevent rotation of the first and second connectors/gates about a generally horizontal axis.

In still another alternative embodiment, such as indicated in FIG. 5B, the hook assembly can comprise a hook support bar 58 or member rigidly supporting at least first and second hooks and slidably supporting a series of hook modules or bocks 55 containing at least first and second clips positioned adjacent the respective first and second hooks. An actuator block can support at least first and second actuators disposed respectively in first and second vertically offset rows. A first connector/gate comprising a first actuator connector portion generally is connected to an output shaft of the first actuator, with a first extension portion extending vertically upwardly from the first actuator connector portion and a first clip connector slot extending from the first extension portion and including lateral walls extending adjacent to two lateral sides of the first clip. A second connector/gate comprising a second actuator connector portion, a second extension portion extending vertically downwardly from the second actuator connector portion, and a second clip connector slot extending from the second extension portion connect with an output shaft of the second actuator. The second clip connector slot includes lateral walls extending adjacent to two lateral sides of the second clip. The first and second actuators can be configured to reciprocally drive the first and second connectors/gates in an axial direction, according to programmed pattern instructions.

As further illustrated in FIGS. 1, 2 and 5B, a series of knife assemblies 60 are provided adjacent the hooks/loopers 36 of the hook assembly 34. The knife assemblies 60 generally include a knife or cutting blade 61 mounted in a holder 62 connected to a reciprocating drive mechanism 63 (FIG. 1). The knives are reciprocated into engagement with the hooks/loopers to cut the loops 38 of yarn selectively captured thereon, as indicated by arrows 64 and 64', to form a series of cut pile tufts in the backing material 11 as it passes through the tufting zone as shown in FIG. 1.

As indicated in FIG. 4A in one example embodiment, the actuators 42 generally can include pneumatic or hydraulic cylinders that are connected via conduits or an air/fluid supply line to an air or other fluid a source or supply 71 of a fluid media such as air, or hydraulic fluid, or other fluid media. Alternatively, other types of actuators, such as servos or other type motors or solenoids, or other, similar drives also can be used. Typically, as shown in FIGS. 3 and 4A, the air or fluid media source 71 will include one or more air tanks 72A/72B with a distribution board, manifold, or plenum 73 mounted to at least one or both of the air tanks as indicated in FIGS. 1 and 4. The manifold 73 generally will include a series of ports 74 to which a series of control valves 75, with integrated solenoids, servos, or other similar type valve-actuators or output relays 76 are mounted. Alternatively, as indicated in FIG. 4B, a control Cabinet 77 can be provided in which a series of servo actuated valves mounted for controlling actuation of the gate actuators 42, and with the air tank(s) and manifold being integrally mounted or contained within the cabinet 77 so that the air/fluid supply and distribution system can be formed as a substantially self-contained unit. As a further alternative, the air tank(s) can be mounted outside of the cabinet, as needed or desired, to fit a desired space or for aesthetics. The valves 75 (FIG. 4A) generally are selectively controlled by the control system 31 for opening and closing the valves to turn on/off the supply of air to the actuators 42 for the connectors/clips as needed for actuating or extending and retracting specific, selected individual connectors/clips in order to form a desired tufted cut/loop pattern. In addition, the hook assembly can include clips for cut/loop loopers and can be mounted on a hook bar or module in a manner to enable replacement of individual hooks or loopers as needed, with the clips tending to be retained in place by the engagement of the gates with the clips.

Figure 6:
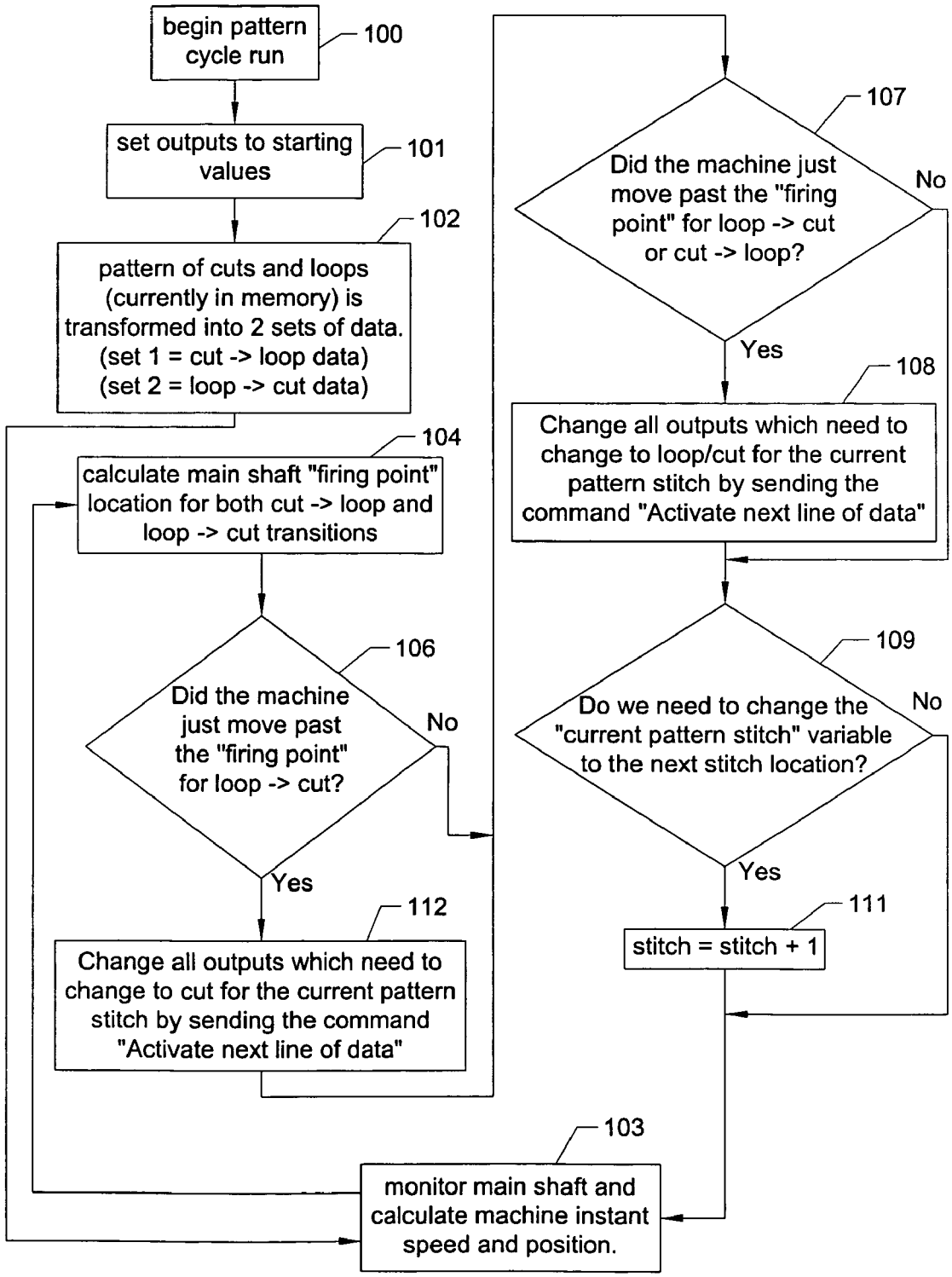
FIG. 6 is a flow chart, schematically illustrating the general operation of the tufting machine of the present invention.

One example embodiment of the method of operation of the tufting machine of the present invention is illustrated in FIG. 6. During such operation, at the start of the pattern cycle (step 100) initial programmed starting output values for the clips, i.e., retracted or extended, are programmed into or set by the control system in an initial step 101. Thereafter, in step 102, a pattern of cuts and loops for a level cut loop tufted article, generally is transformed into at least two sets of data (i.e., set 1=cut to loop transitions data, while set 2=loop to cut transition data). During operation, the main shaft of the tufting machine will be constantly monitored (step 103), such as through the use of an encoder 80 (FIG. 1), or similar position or speed sensing mechanism to calculate an instant speed and/or position of the main shaft, and thus the needles, i.e., where the needles are in the process of a sewing cycle and the needles move from a raised top dead center start position to a lowered position penetrating the backing fabric, and a raised initial position.

The system can calculate at least one and generally two or more separate "firing points" or transition points per revolution of the main shaft of the tufting machine or stroke or cycle of the needles. At these firing points, a "firing signal" will be sent to the valve actuators for fluid valves 75 (FIG. 4A) so that the gates will be fired or moved so as to transition the selected clips to and/or from their extended and retracted positions/states. The timing of the sending of such firing signals will also generally be determined by taking into account the needle positions as well as the time needed for the firing signal to reach its intended valve actuator, as well as the time needed for the selected actuator to fully extend or retract its gate and clip. The controller 31 further generally will have sufficient processing capabilities/power to calculate and/or adjust the next firing points or transition step or steps in the pattern cycle (for example, calculating a next change of state one or more stitches in advance of such change) and compensate for dynamic speed advance of the tufting machine, as well as be able to control/engage and change the states of the output relays of the fluid control valves at two or more locations or points of rotation of the main shaft, as indicated in step 104 (FIG. 6).

For example, as shown in steps 106-107, if the machine has not passed a firing or transition point (106), when the current stitch is loop and the next stitch is to be cut, (107) the actuators controlling the clips for the selected hooks generally are held in an extended configuration, approximately until the needles are approaching or are in a raised, substantially top dead center position, after which the cylinders are fired/closed and thus their clips are retracted prior to the hooks striking the needles. Alternatively, when the current stitch is cut and the next selected stitch is a loop stitch, the actuators can be held in a retracted state until the needles are about half-way into their upward motion of their stroke or cycle, where the yarns are becoming tightened about the hooks, after which the actuators are fired/extended. Thereafter, the outputs will be changed to loop/cut for the next stitch as noted in step 108.

For no change in the next stitch (i.e., cut to cut or loop to loop), no change in state/motion is required, and the system will then determine if a change in the current pattern stitch variable, to a next stitch location is needed (step 109). Thereafter, the system proceeds to the next stitch (as shown at step 111), but even if a change is not needed, the system continues to calculate new "firing points" for the upcoming cut to loop and loop to cut transitions, typically looking for and/or calculating a next firing point two or more stitches in advance of the current pattern stitch. Further, if the sewing cycle has progressed past the firing point for either the transition from cut to loop or the transition from loop to cut, the system will automatically change outputs needed to change the sewing to loop or to cut as required for the upcoming stitch/stitches by sending the command "Activate the next line of data," as indicated by step 112.

Figure 7A:
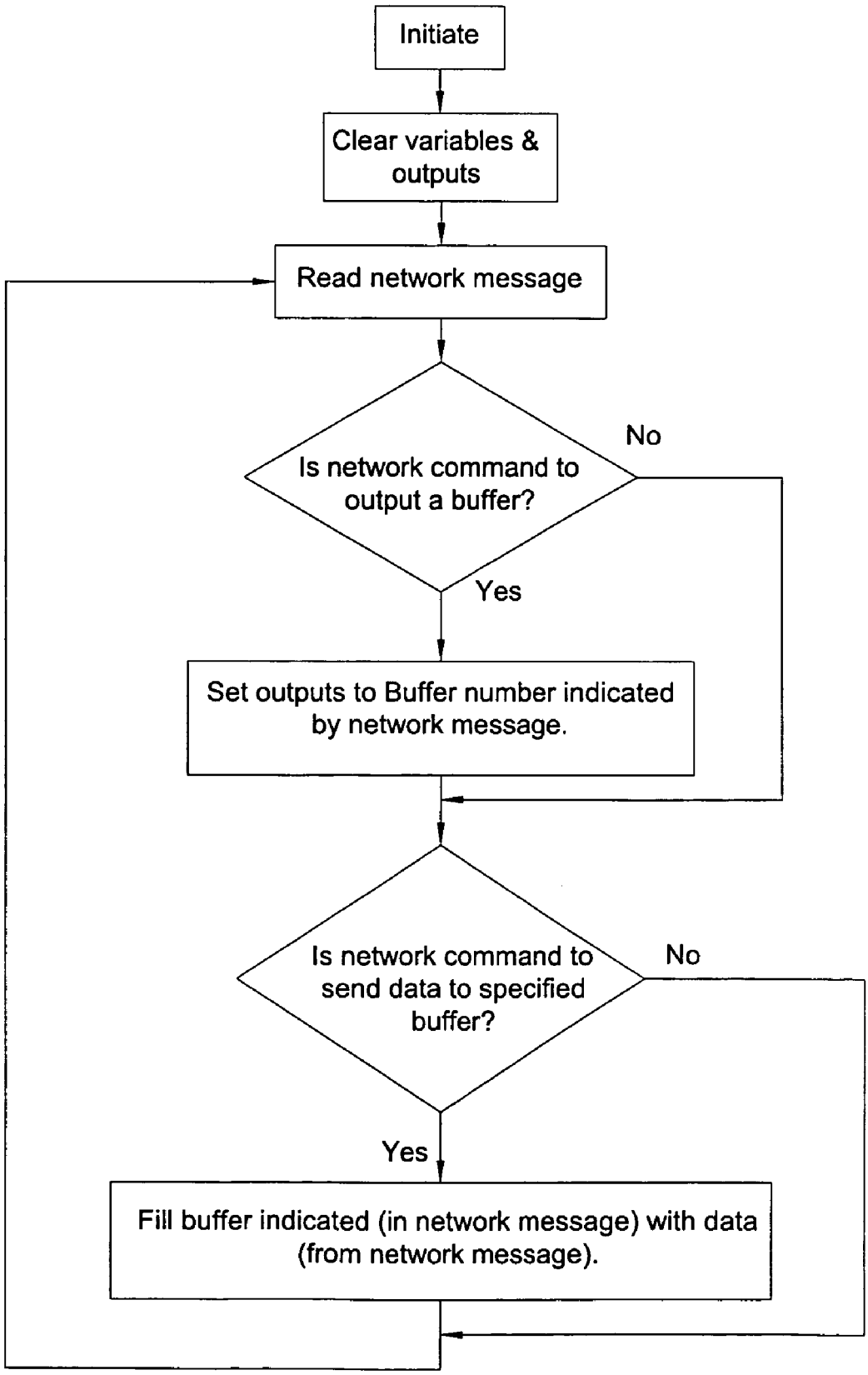
Figure 7B:
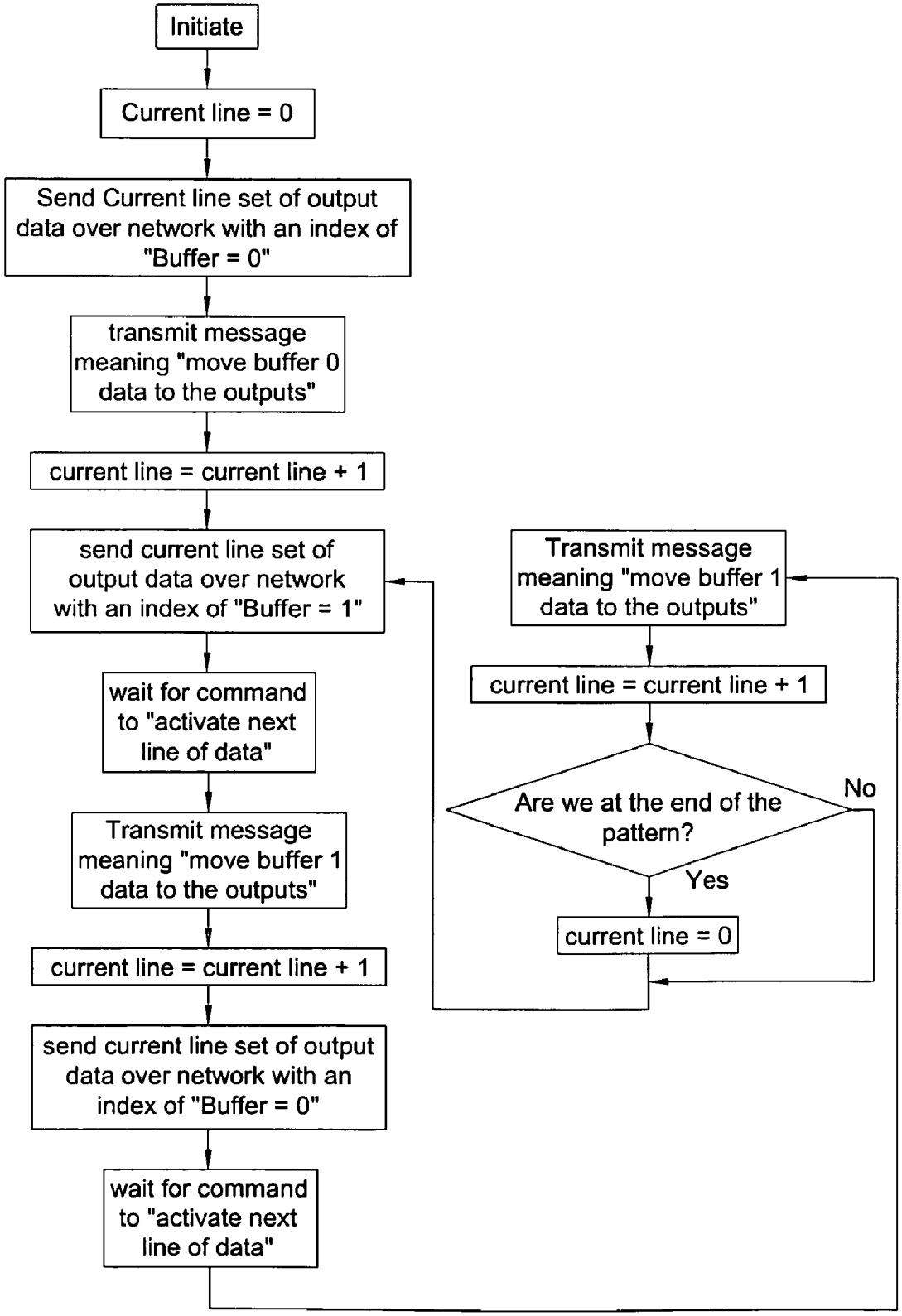

FIGS. 7A and 7B illustrate further alternative embodiments for the operation of the control system for firing the actuators as needed to make the transitions from cut pile to loop pile tufts and from loop to cut pile tufts. FIG. 7A generally illustrates a network mode in which a series of processors can be provided for controlling groups of one or more of the output relays of valves selected to enable changing of input and outputs of the gate actuators 37 (FIGS. 1, 2 and 4) in parallel with a single message sent from the main computer or processor of the tufting machine control system. Thus, in such a system, the tufting machine controller will send out a broadcast message over the network to tell each of the processors to make the change from either cut to loop or loop to cut, and will further update each of the processors as to the next step or steps to be performed in the pattern.

As indicated in FIG. 7A, when the control system sends out the broadcast message to initiate a change, the processors for controlling the groups of one or more valve actuators will be cleared of presently stored variables and outputs and will receive and process the broadcast network message. The processors will initially determine whether the broadcast network message is to be temporarily stored in a buffer or delayed for a desired time so as to enable coordinated firing of the selected gate actuators. If so, the processors will set the network command outputs to a buffer number, as indicated in the network message, and if not, the system will proceed to determine what data contained within the network message is to be sent to a specified buffer. If so, the data (transition points) are then populated within the desired buffer indicated in the network message and the processors for the valve actuators thereafter continue to control the actuation of the valve actuators according to this newly received programmed information until receipt of the next broadcast network message. Further, if the network used is fast enough, the buffer can be substantially reduced and/or possibly eliminated such that a next change of state can be initiated substantially upon the sending of the firing signal.

Alternatively, FIG. 7B illustrates a streaming and double buffering control mode for operating the level cut-loop tufting operation typically via a network/serial or other communication path. In such a mode of operation, the controller of the tufting machine control system will send out signals to groups of one or more solenoid activated valve relays 76 for the control valves 75 (FIGS. 1 and 4), typically starting with the valve relays that control operation of the actuators or group of gate actuators that is furthest out of phase from the operation of the tufting machine, i.e., based on position of the main shaft for the next transition or firing point. Thus, the firing signal sent to each valve relay or set of relays generally will be sent in time sufficient to compensate for any delay in the timing of the firing signal getting to each valve relay or set of valve relays for the selected gate actuators. Accordingly, the controller will monitor and adjust the sending of the firing signals based upon the speed of the machine at the time the firing signal is being sent, so as to ensure that each firing signal sent will reach its intended valve relay or set of valve relays in sufficient time necessary to actuate the firing substantially simultaneously with the firing of the other valve relays or sets of relays as needed for forming the desired or programmed level cut loop pattern.

The following Table I illustrates an example firing point for transitioning from cut to loop and loop to cut, in an example pattern where C=cut and L=loop, and with the pattern alternating between the formation of two cut and two loop piles, and the formation of one pattern of cut and loop pile tufts in series.

TABLE I

| Mainshaft Degrees | Current Outputs | Next Outputs Needed |
|---|---|---|
| 0 | CL CL CL CL | CC LL CC LL |
| 90 | CC CL CC CL | |
| 200 | CC LL CC LL | |
| 0 | CC LL CC LL | CL CL CL CL |
| 90 | CC CL CC CL | |
| repeat again | repeat again | repeat again |

Accordingly, with the present invention, the reaction time of the gate actuators (cylinders) generally should not be a significant limitation on the operation of the machine, while the mass of the hook bar and cylinders of the hook assembly and time required for each selected gate to be extended/retracted after a firing or transition signal is sent can be taken into account and compensated for in determining the next firing point or change of state. The following Table II illustrates example retract and extend times for the gate actuators/cylinders based on the speed of the operation of the tufting machine. Such times are approximate example time and it will be understood that such times could vary.

TABLE II

| RPM | Extend Time | Retract Time |
|---|---|---|
| 600 | 50 ms | 77 ms |
| 700 | 43 ms | 66.6 ms |
| 750 | 40 ms | 62 ms |
| 800 | 37.5 ms | 58.33 ms |
| 850 | 35.3 ms | 55 ms |
| 900 | 33.3 ms | 51.9 ms |
| 950 | 31.6 ms | 49 ms |
| 1000 | 30 ms | 46.5 ms |
| 1050 | 28.5 ms | 44.5 ms |
| 1100 | 27.2 ms | 42.4 ms |
| 1200 | 25 ms | 38.8 ms |

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A tufting machine for forming cut pile and loop pile tufts in a backing material, comprising:

a reciprocating needle bar having a series of spaced needles mounted therealong;

a yarn feed mechanism for supplying a series of yarns to the needles;

a hook assembly below the needles and including a series of loopers or hooks that are moved in a reciprocating motion into engagement with the needles as the needles penetrate the backing material in order to form loops of yarn within the backing material;

a clip assembly including a series of clips engaging each of the loopers or hooks, and a series of actuators for moving the clips between engaging and non-engaging positions; and a control system monitoring the position of the needle bar with respect to the backing material and calculating at least two separate firing points for causing a change of state of the clips per a stroke of the needle bar to enable selective actuation of the clips to cause transitions from cut pile to loop pile tufts, and from loop pile to cut pile tufts to form a desired cut-loop pattern.

2. The tufting machine of claim 1 and wherein the control system comprises a network control system including a controller in which pattern information is stored, and a series of processors, each controlling operation of one or more of the actuators, and wherein the main controller sends a broadcast message to all of the processors to enable activation of the transition from cut to loop or loop to cut in parallel.

3. The tufting machine of claim 1 and further comprising a series of valves supplying a fluid media to the actuators wherein the control system comprises a controller that controls each of the valves, and wherein the controller sends a series of transition signals to each valve or a group of valves starting with the valves or groups of valves that are furthest out of phase from the operation of the tufting machine to cause firing of the actuators at a desired time based upon a time for full actuation of the actuator and a time for the transition signals reaching each valve or set of valves.

4. The tufting machine of claim 1 and further comprising a fluid supply and a series of valves for controlling the supply of a fluid media to the actuators for the clips to cause movement of the clips between their extended and retracted positions.

5. The tufting machine of claim 4 and wherein the fluid media comprises air and the fluid supply comprises at least one air tank.

6. The tufting machine of claim 1 and wherein the gate actuators comprise cylinders and having a cylinder rod and an actuator connector connecting their cylinder rod to a selected clip.

7. The tufting machine of claim 1 and further comprising a series of knives moveable into engagement with the loops of yarns on the loopers or hooks so as to cut the loops of yarns to form cut pile tufts in the backing material.

8. A method of forming loop and cut pile tufts in a backing comprising:

moving the backing along a path of travel through a tufting zone;

reciprocating a series of needles carrying a series of yarns into and out of engagement with the backing;

as the needles engage the backing, engaging the needles with a series of loopers/hooks to form loops of yarns in the backing;

cutting at least some of the loops of yarn to form cut pile tufts;

monitoring the reciprocation of the needles and calculating at least one firing point per revolution of a main shaft driving the needles for a next change of state of a series of clips for the loopers/hooks; and selectively actuating the clips according to the calculated next change of state of the clips to move the clips between extended and retracted positions to facilitate transition from the formation of cut pile tufts to loop pile tufts and from the formation of loop pile tufts to cut pile tufts;

wherein calculating at least one firing point comprises calculating two firing points per revolution of the main shaft at least one stitch in advance of the next change of state of the clips.

9. The method of claim 8 and further comprising sending a transition signal for actuating each clip.

* * * * *